US007029934B2

(12) United States Patent
Chikamatsu et al.

(10) Patent No.: US 7,029,934 B2
(45) Date of Patent: Apr. 18, 2006

(54) METHOD AND APPARATUS FOR TESTING TFT ARRAY

(75) Inventors: Kiyoshi Chikamatsu, Kanagawa (JP); Kayoko Tajima, Tokyo (JP)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 11/176,707

(22) Filed: Jul. 7, 2005

(65) Prior Publication Data

US 2006/0046324 A1 Mar. 2, 2006

(30) Foreign Application Priority Data

Sep. 1, 2004 (JP) ..... 2004-254122

(51) Int. Cl.
*H01L 21/66* (2006.01)

(52) U.S. Cl. ..... 438/17; 438/10; 438/11; 438/18

(58) Field of Classification Search ..... 438/10, 438/11, 14, 17, 18; 324/548, 658, 659, 660, 324/679, 672, 770
See application file for complete search history.

(56) References Cited

U.S. PATENT DOCUMENTS

| | | | | |
|---|---|---|---|---|
| 5,179,345 | A * | 1/1993 | Jenkins et al. | 324/678 |
| 5,561,381 | A * | 10/1996 | Jenkins et al. | 324/678 |
| 5,866,444 | A * | 2/1999 | Yamazaki et al. | 438/151 |
| 6,633,135 | B1 * | 10/2003 | Nara et al. | 315/169.3 |
| 6,815,975 | B1 | 11/2004 | Nara et al. | 324/770 |
| 2002/0058343 | A1 * | 5/2002 | Gruverman et al. | 438/3 |
| 2003/0187597 | A1 | 10/2003 | Taguchi et al. | 702/65 |
| 2004/0141131 | A1 * | 7/2004 | Ishikawa et al. | 349/139 |
| 2005/0190169 | A1 * | 9/2005 | Tajima | 345/204 |

* cited by examiner

*Primary Examiner*—Kevin M. Picardat

(57) ABSTRACT

A testing method for a TFT array substrate using a self-emitting element drive where pixels are arranged in a matrix and each pixel comprises a drive transistor having a gate formed from a first structural material and a source and a drain formed from a second structural material, and a hold capacitor having a first electrode formed from the first structural material and a second electrode formed from the second structural material, where the testing method comprises a first step for applying a first voltage to the hold capacitor; a second step for applying a second voltage to the hold capacitor after the first step; a third step for measuring the charge in the pixel after applying the second voltage; and a fourth step for calculating the capacitance of the hold capacitor from the charge and the potential difference between the first voltage and the second voltage.

4 Claims, 5 Drawing Sheets

METHOD AND APPARATUS FOR TESTING TFT ARRAY

FIELD OF THE INVENTION

The present invention relates to a method and an apparatus for testing a TFT array, and more particularly, to a testing method and a testing apparatus for a TFT array substrate using self-emitting elements having drive transistors and hold capacitors manufactured by the same process.

DISCUSSION OF THE BACKGROUND ART

The flat panel displays (FPDs) used in personal computer monitors, televisions, and cellular phones are constructed from display elements such as liquid crystal or electroluminescent (EL) elements and a thin-film transistor array (TFT array) for electrically controlling the states of the display elements. As shown in FIG. 1, the TFT array substrate 16 is configured with a plurality of pixels 27 arranged in a matrix. Gate control lines 22 and data lines 20 are disposed horizontally and vertically and connected to the pixels 27. Each pixel is controlled by selecting the pixel to be controlled by a gate control line 22 and a data line 20, and the display luminance is set by the voltage applied to the data line 20.

Over the past few years, self-emitting elements like organic EL elements have gained attention as display elements. A self-emitting element has the property of emitting light, has a wide displayed color range, and is suited to smaller and lighter weight FPDs. Therefore, a TFT array for self-emitting elements requires a control circuit for controlling the drive current of the self-emitting element by a voltage applied to the data line 20.

FIG. 2 is an example of the structure of a pixel 27 in a typical TFT array 16 for EL elements formed from two p-channel polysilicon TFTs. This example shows an example circuit configuration using p-channel TFTs, but can similarly be applied to n-channel TFTs. The case of using polysilicon for the silicon layer of the TFT is cited, but an amorphous silicon layer can be used.

The gate of a pixel selection transistor 23 is connected to the gate control line 22 and the drain to the data line 20. The source of the pixel selection transistor 23 is connected to the gate of a drive transistor 24 and a first electrode of a hold capacitor 25. The source of the drive transistor 24 and a second electrode of the hold capacitor 25 is connected to a power supply line 21. The drains of the drive transistors 24 are connected to the EL elements 26 when the FPD is completed, but the EL elements 26 in the TFT array 16 state are in the open state because the elements are not sealed.

Next, the operation of a pixel 27 is explained. Since the gate control line 22 normally has the off voltage (normal) in the range of 5 to 10 V applied by the positive power supply voltage of the logic circuit in the FPD, the pixel selection transistor 23 of each pixel enters the off state. When a pixel is controlled, first, the on voltage, for example, −5 V, is applied to the gate control line 22 connected to the pixel 27 (selection pixel) to be controlled. This places the gap between the drain and the source of the pixel selection transistor 23 in the conducting state. The voltage V corresponding to the desired emitted light luminance is applied to the data line 20. Then the hold capacitor 25 is charged, and the voltage between the gate and source of the drive transistor 24 is held in the difference between the potential of the power supply line 21 and the potential V of the data line 20. Since the hold capacitor 25 is connected to the gate and source of the drive transistor 24, the EL element drive current corresponding to the voltage V flows between the drain and source of the drive transistor 24. However, in the TFT array state, the drive current does not flow because the EL element is not sealed and the drain is in the open state.

A TFT array 16 is formed on a glass substrate. FIG. 3(*b*) is a cross-sectional view of the glass substrate forming the TFT array, and (a) shows the corresponding circuit. In the layout relationship shown in (a), the power supply line 21 is divided into two lines, but both lines are electrically connected and are the same line.

The control circuit of the TFT array 16 is formed on the glass substrate 30 coated with a cover coating layer 31. First, undoped polysilicon layers 23*p*, 24*p* are formed at the positions opposite the gate layers 23*g*, 24*g* of the transistors 23, 24, and p-type semiconductor layers (polysilicon layer doped with boron) are formed at the positions of the drains and sources. The hold capacitor 25 uses the polysilicon layer 25*p* at the position opposite the first electrode 25*g* as the second electrode, and the insulating layer 32 and the depletion layer possible in the polysilicon layer as the dielectric layer, to form the so-called MOS capacitor.

Each layer is covered by a first insulating layer 32, and metal wiring layers 20*m*, 28, 29, 21*m* are disposed at the drains 23*d*, 24*d* and the sources 23*s*, 24*s*, respectively. The metal wiring layers 20*m*, 21*m* are connected to the data line 20 and the power supply line 21, respectively. The gate layers 23*g*, 24*g* of the transistors 23, 24 formed from structural materials and the second electrode 25*g* of the hold capacitor 25 formed from the same structural materials are formed with the top layer of the first insulating layer 32. Although not shown, the gate layer 24*g* of the drive transistor 24 and the source layer of the pixel selection transistor 23 are electrically connected. To construct the circuit shown in FIG. 2, the metal wiring layer 21*m* and the second electrode 25*g* must also be electrically connected. However, the metal wiring layer 21*m* and the second electrode 25*g* do not necessarily have to be electrically connected, and a different voltage is sometimes applied depending on the usage state. A second insulating layer 33 is formed to cover the gate layers 23*g*, 24*g* and the second electrode 25*g*. Furthermore, a protective layer 34 is formed as the top layer.

As is clear from FIG. 3, the hold capacitor 25 is formed from the first electrode 25*g* and the second electrode 25*p*, and p-type semiconductor layer 23*s* is disposed adjacent to the second electrode 25*p* and opposite the metal layer 25*g*. This structure has the same structure as gate layer 24*g* and the polysilicon layer 24*p* in drive transistor 24 and the p-type semiconductor layers 24*s*, 24*d* disposed adjacent thereto. Thus, since the drive transistor 24 and hold capacitor 25 on the TFT array can be formed in the same structure, they are often fabricated by a common process.

The gate capacitor of the drive transistor 24 and the hold capacitor 25 formed by the common process and having the same dielectric material (insulating layer 32) and thickness of the insulating layer have nearly equal electrical characteristics such as the capacitance per unit area and the dependence of the capacitance on the voltage.

In this application, the structural materials are the materials forming the transistors or the electrodes of the hold capacitors. For example, the structural material of the gate of the pixel selection transistor 23 is metal for forming the gate 23*g*. The structural materials of the drain and source are p-type semiconductors forming the drain 23*d* and the source 23*s*. The structural material of the gate of the pixel selection transistor 23 does not necessarily have to be metal, but can be a material like tungsten silicon or polysilicon. Similarly, the structural material of the first electrode of the hold capacitor 25 is a metal forming electrode 25*g*, and the structural material of the second electrode is the p-type semiconductor forming electrode 23*s*. The structural materials, physical dimensions such as the film thickness, and the manufacturing method for forming the structural materials on a substrate are appropriately selected to match the electrical specifications demanded for the transistors and hold capacitors.

Because the TFT array substrate 16 has a wide area, it is difficult to manufacture with uniform electrical characteristics of the functional components (transistors and hold capacitors) on the substrate over the entire surface. Therefore, the problem is the resulting fluctuations in the drive current flowing between the drain and source of the drive transistor 24 in each pixel produce fluctuations in the luminance of the emitted light. If the fluctuations are small, this does not present a problem in practice, but fluctuations above a designated level are unsuited to products. Therefore, a decision about the quality of the manufactured TFT array is required.

The decision on the quality of the TFT array is desired before sealing the self-emitting material because self-emitting elements such as organic EL materials are usually expensive. In the state before sealing the EL elements 26, the problem is the drive current cannot be directly measured because the drain terminal of the drive transistor 24 is in the open state.

SUMMARY OF THE INVENTION

A testing method for a TFT array substrate using a self-emitting element drive where pixels are arranged in a matrix and each pixel comprises a drive transistor having a gate formed from a first structural material and a source and a drain formed from a second structural material, and a hold capacitor having a first electrode formed from the first structural material and a second electrode formed from the second structural material, where the testing method comprises a first step for applying a first voltage to the hold capacitor; a second step for applying a second voltage to the hold capacitor after the first step; a third step for measuring the charge in the pixel after applying the second voltage; and a fourth step for calculating the capacitance of the hold capacitor from the charge and the potential difference between the first voltage and the second voltage.

The drive current I flowing between the drain and source of the drive transistor 24 can be expressed as follows when the operating point of the transistor 24 is in the saturation region ($|V_{ds}|>|V_{gs}|-|V_{th}|$, $|V_{gs}|>|V_{th}|$, where $V_{th}$ is the threshold voltage, $V_{gs}$ is the voltage between the gate and source, and $V_{ds}$ is the voltage between the drain and source).

$$I=\mu\cdot W\cdot C_{ox}\cdot(1+\lambda\cdot V_{ds})\cdot(V_{gs}-V_{th})^2/2L$$

where μ denotes the drift mobility of a small number of carriers in the channel; W, the channel width; $C_{ox}$, the gate insulating film capacitance per unit area; λ, the channel length modulation coefficient; and L, the gate length.

When the operating point of the transistor 24 is in the linear region ($|V_{ds}|\leqq|V_{gs}|-|V_{th}|$), the drive current I can be expressed as follows.

$$I=\mu\cdot W\cdot C_{ox}\cdot(V_{gs}-V_{th}-V_{ds}/2)\cdot V_{ds}/L$$

The drive current of the drive transistor 24 during organic EL operation has a proportional relationship to the gate insulating film capacitance $C_{ox}$ per unit area in either the linear region or the saturation region.

The capacitance Cs of the hold capacitor 25 can be expressed by $$Cs=C_{ox}\cdot W'\cdot L'$$

where W'·L' is the area of the hold capacitor. Cs and $C_{ox}$ have a proportional relationship. From the description in paragraph 0009, the gate capacitance of the drive transistor and the hold capacitance disposed in adjacent regions about 100 μm apart in the same pixel can be considered to have the same $C_{ox}$ (this concept is referred to as matching). Consequently, the relative variations in the FPD surface of the current I in the drive transistor can be estimated by determining the relative variations in the FPD surface of the hold capacitance Cs.

Since the nonuniformity in the demanded current has relative variations in the FPD surface, the nonuniformity of the drive current I flowing in the drive transistor 24 can be estimated by determining the nonuniformity in the capacitance Cs of the hold capacitor 25 that can be measured even in the TFT array substrate state. Furthermore, the nonuniformity in the luminance of organic EL can be estimated by determining the nonuniformity in the capacitance Cs of the hold capacitor 25 because an EL element emits light at a light intensity corresponding to the drive current.

The capacitance of the hold capacitor of the TFT array can be measured, and the nonuniformity of the drive current can be extracted. Furthermore, the nonuniformity in the luminance of the organic EL can be estimated.

DETAILED DESCRIPTION OF THE PREFERRED EMBODIMENT

Next, with reference to the drawings, typical embodiments of the present invention are explained.

Figure 1:
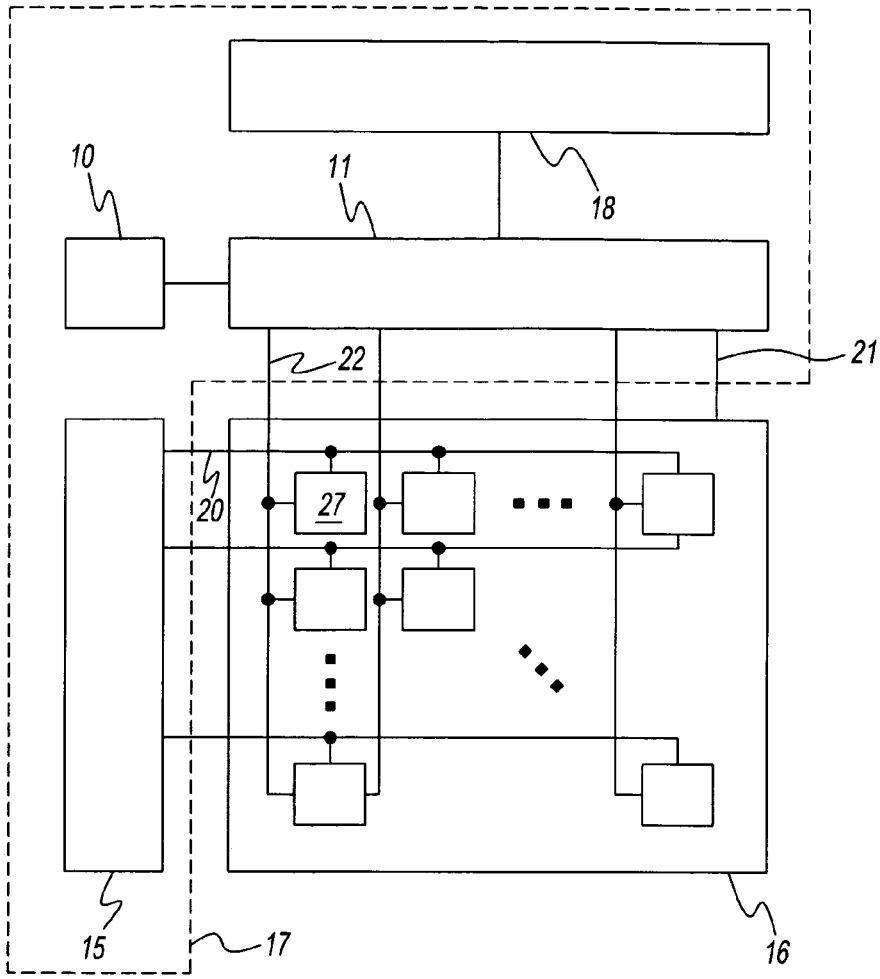
FIG. 1 is a schematic diagram of a TFT array and a testing apparatus.
Figure 2:
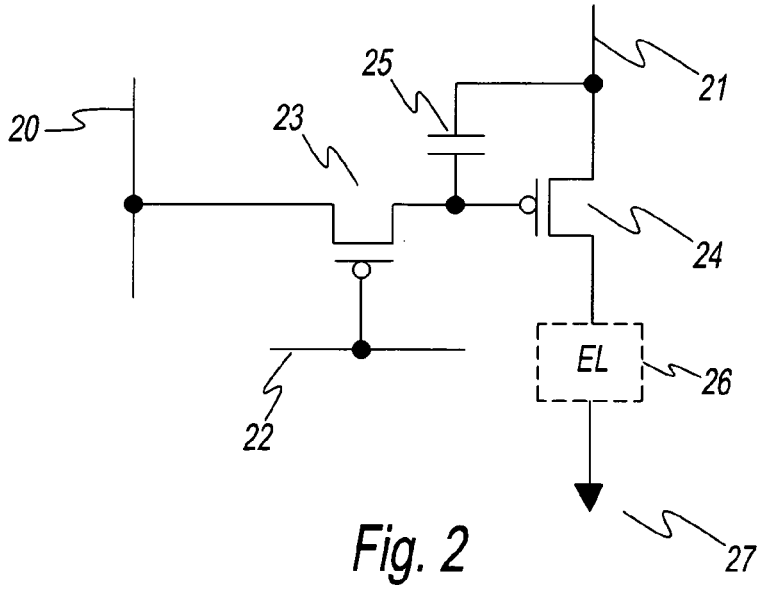
FIG. 2 is a circuit diagram of each pixel in the TFT array.
Figure 3:
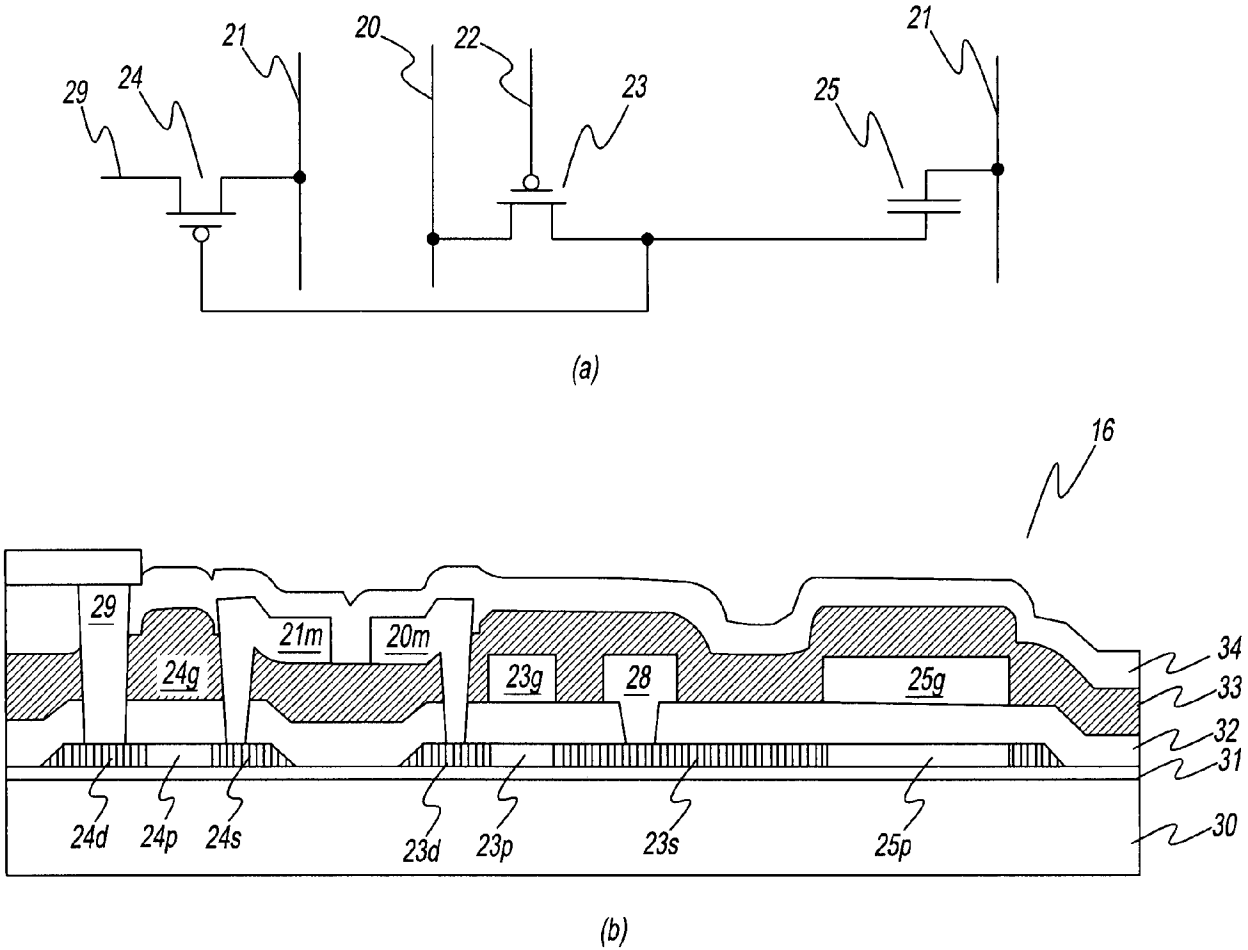
FIG. 3 is a cross-sectional view of a pixel.

FIG. 1 is a schematic drawing of the TFT array substrate 16 and the testing apparatus 17. The testing apparatus 17 comprises a variable voltage power supply 10 for applying voltage to a data line 20 of the TFT array 16, a coulomb meter 14 for measuring the charge in a pixel, a control apparatus 11 that is connected to and controls the variable voltage power supply 10, gate control lines 22, and power supply line 21, and a processor 18 connected to the control apparatus 11. The processor 18 comprises memory and a processor, and has the functions for calculating the capacitance of the hold capacitor 25 from the measurements, storing the calculation result in memory, and determining the nonuniformity of the capacitance. The variable voltage power supply 10 may be used instead of a plurality of constant voltage power supplies. Instead of the coulomb meter 14, an ammeter can be disposed and measure the time elapse of the amount of current and integrate the measurement to determine the charge. The structure of the TFT array substrate 16.

Figure 5:
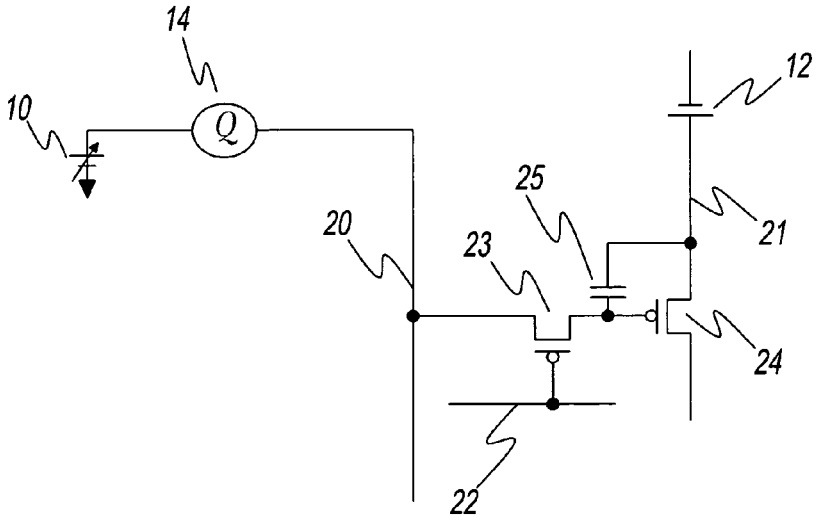
FIG. 5 is a circuit diagram showing the electrical connections of the testing apparatus and each pixel.

FIG. 5 is a circuit diagram showing the electrical connections between a pixel 27 of the TFT array 16 and an element of the testing apparatus 17. The gate of the pixel selection transistor 23 is connected to the gate control line 22, and the drain to the data line 20. The gate control line 22 is connected to the variable voltage power supply 10 and the coulomb meter 14. The source of the pixel selection transistor 23 is connected to the gate of the drive transistor 24 and the first electrode of the hold capacitor 25. The source of the drive transistor 24 and the second electrode of the hold capacitor 25 are connected to the power supply line 21. The power supply line 21 is connected to the power supply 12.

Figure 6:
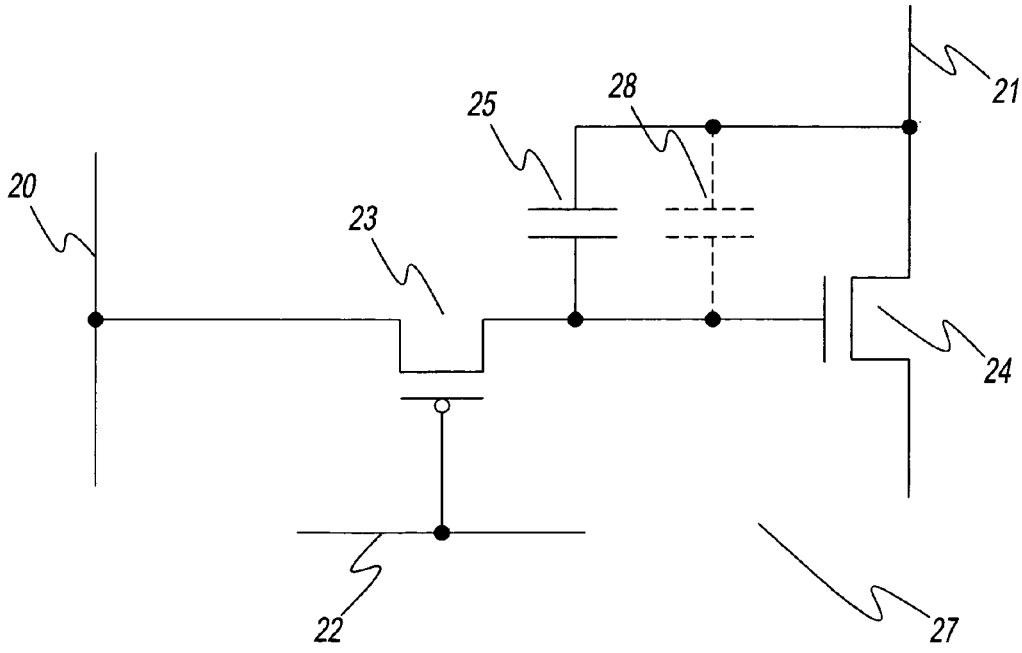
FIG. 6 is a view illustrating the capacitance $C_{gs}$ between the gate and source.

As described above, since a capacitance $C_{gs}$ due to the gate insulating film exists between the gate and source of the drive transistor 24, as shown in FIG. 6, the hold capacitor 25 and the capacitor between the gate and source are connected in parallel between the gate and source of the drive transistor 24. Consequently, the capacitance measured by the testing apparatus 17 is strictly the combined value of the capacitance $C_s$ of the hold capacitor 25 and the capacitance $C_{gs}$ of the gate-source capacitor 28 of the drive transistor 24. Naturally, since the capacitance $C_{gs}$ of the gate-source capacitor 28 is a value proportional to the gate insulating film capacitance $C_{ox}$ per unit area, the two do not have to be separated and handled when testing the nonuniformity of the electrical characteristics of the pixel. In the specification and the claims, except when specified in particular, the capacitance of the hold capacitor means the idea of including sum of the capacitance $C_s$ of the hold capacitor 25 and the capacitance $C_{gs}$ of the gate-source capacitor 28 of the drive transistor 24 is included in addition to the capacitance of the individual capacitance $C_s$ of the hold capacitor 25.

Figure 4:
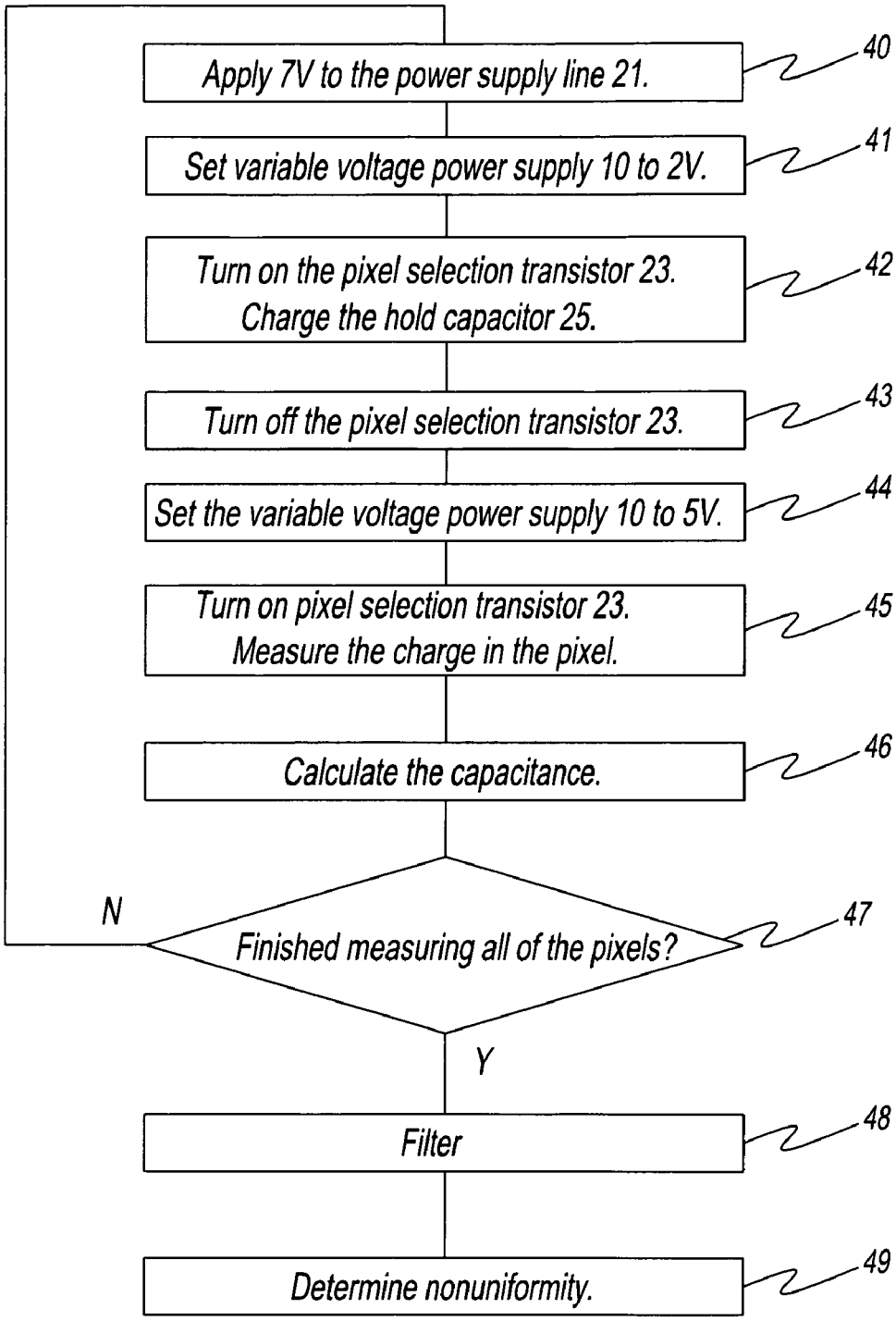
FIG. 4 is a flow chart of the operation of the testing apparatus.

Next, the test process is explained with reference to the flow chart in FIG. 4. The hold capacitor 25 of the pixel in the first row and first column is measured. The control apparatus 11 applies 7 V ($V_o$) to the power supply line 21 (Step 40) and sets the output voltage of the variable voltage power supply 10 to 2 V (first voltage $V_1$) (Step 41). Then −5 V is applied to the gate control line 22, the pixel selection transistor 23 turns on, and the hold capacitor 25 charges (Step 42). The voltage between the ends of the hold capacitor becomes 5 V ($=V_o-V_1$). The voltage applied to the gate control line 22 is temporarily set to 7 V, and the pixel selection transistor 23 turns off (Step 43). The voltage of the variable voltage power supply 10 is set to 5 V (second voltage $V_2$) (Step 44) and the voltage applied to the gate control line 22 is again set to −5 V. Consequently, since a potential difference of 3 V ($=V_2-V_1$) is produced in the drain-source voltage $V_{ds}$ of the pixel selection transistor 23, current flows in the data line 20. The current flowing in this pixel 27 decreases as the charge stored in the hold capacitor 25 becomes small and continues to flow until the source voltage $V_s$ of the pixel selection transistor 23 becomes the output voltage $V_2$ of the variable voltage power supply. The total charge Q due to the current flowing in pixel 27 is measured by the coulomb meter 14 (Step 45). $C_s=Q/(V_2-V_1)$ can be determined from the measured total charge Q because the total charge Q is represented by the product of $C_s$ and $V_2-V_1$ (Step 46).

The same measurement process is sequentially applied to the pixel in each column of the first row, then sequentially to the pixels in each column from the second row, third row, . . . , last row. The capacitance $C_s$ of the hold capacitor 25 is determined for all of the pixels and stored in the memory of the processor 18 (Step 47). The distribution data in the surface of the capacitance $C_s$ is stored as a 2-dimensional array following the actual sub-pixel lines in the TFT array 16. The testing apparatus 17 of this embodiment has a function for displaying in gray scale the magnitude relationship of the capacitance $C_s$ stored in this 2-dimensional matrix.

Next, a filter is applied to the array of capacitances $C_s$ (Step 48). The testing apparatus of this embodiment determines the average of the on resistances of a total of five pixels of the current pixel and the four surrounding pixels vertically and horizontally for each pixel. However, this filtering can be the application of other 2-dimensional low-pass filters because the object is to remove large gradient information in the 2-dimensional array.

Finally, the processor 18 takes the difference between each array element of the array before filtering and each array element of the array after filtering and extracts the nonuniformity of the capacitance $C_s$ (Step 49). A pixel having a nonuniformity magnitude above a threshold is determined to be a bad pixel.

The threshold used in the quality decision is determined as follows. The capacitance $C_s$ is measured and the nonuniformity is extracted as described above for the TFT array known beforehand to have nonuniformity in the luminance. The difference between the difference of the array element for pixels having luminance nonuniformity and the average of the differences of pixels without luminance nonuniformity is determined. This difference becomes the threshold for the quality decision.

In this embodiment, the hold capacitors 25 of all of the pixels are measured and the nonuniformities are extracted, but the decision can use the measurement results of measuring every couple of pixels in order to shorten the testing time. When a tendency to fluctuate is seen beforehand, designated parts can be focused on and the measurements made and nonuniformity extracted. In nonuniformity extraction (Step 49), an array element pair ratio can be taken without taking the difference between an array element pair as described above. Furthermore, the threshold for the pixel quality decision does not necessarily need to be determined empirically as described above, and the threshold can be a value corresponding to a specified percentage (i.e., 3%) with respect to the average of the capacitances of the hold capacitors of all measured pixels.

Figure 7:
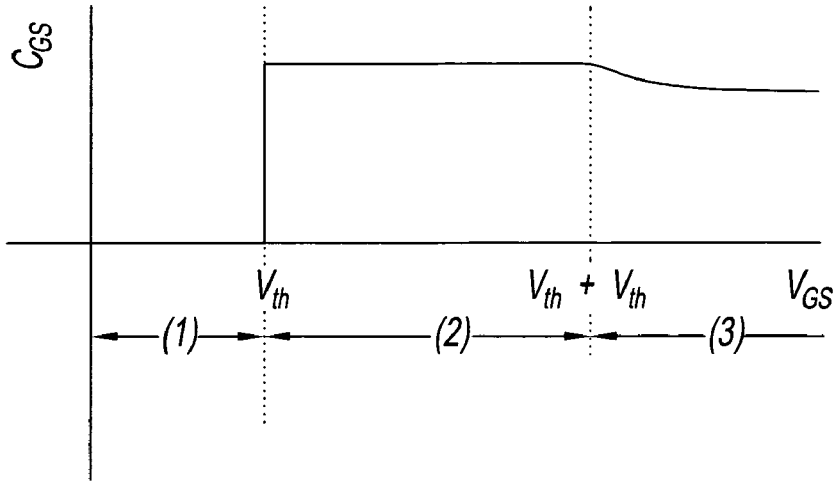
FIG. 7 is a view showing the relationship between the gate-source voltage $V_{gs}$ and the gate-source capacitance $C_{gs}$.

The capacitance measured by this testing method can be used to determine whether the threshold voltage $V_{th}$ of the drive transistor 24 is within the designated range. As in FIG. 7, the capacitance $C_{gs}$ between the gate and source of drive transistor 24 is varied by the gate-source voltage $V_{gs}$ and becomes an extremely small constant $C_{gso}$ in the sub-threshold region ($|V_{gs}|\leqq|V_{th}|$) indicated by (1). In the linear region ($|V_{ds}|\leqq|V_{gs}|-|V_{th}|$) indicated by (3), let the saturation voltage be $V_{SAT}=V_{gs}-V_{th}$, $$C_{gs}=2\ V_{SAT}\cdot(3V_{SAT}-2V_{ds})\cdot C_{ox}/3\ (2V_{SAT}-V_{ds})^2+C_{gso}$$

and $$C_{gs}=2\ C_{ox}/3+C_{gso}$$

in the saturation region ($|V_{ds}|>|V_{gs}|-|V_{th}|$, $|V_{gs}|>|V_{th}|$) indicated by (2). Both values are greater than $C_{gso}$.

As described above, since the capacitance measured by the measurement method of this embodiment is a combined value of the capacitance $C_s$ of the hold capacitor 25 and the capacitance $C_{gs}$ of the gate-source capacitor 28 of the drive transistor 24, when the charging voltage $V_c$ of the hold capacitor 25 is less than the threshold voltage $V_{th}$ of the drive transistor 24, the combined value becomes smaller because the capacitance of the gate-source capacitor 28 becomes $C_{gso}$. Since the charging voltage $V_c$ is the difference between the output voltage $V_o$ of the power supply 12 and the voltages $V_1$, $V_2$ of the variable voltage power supply 10 ($V_o-V_1$, $V_o-V_2$), the measured capacitance becomes much less than the theoretical value in the design except when this difference is in the (2) saturation region or the (3) linear region. The decision on whether the threshold voltage $V_{th}$ of the drive transistor 24 is in the tolerance region is made by setting $V_1$ and $V_2$ and measuring the capacitance so that either $V_o-V_1$ or $V_o-V_2$ becomes the maximum or minimum of the allowed threshold voltage $V_{th}$.

The technical concepts of the present invention were explained in detail above while referring to a specific embodiment, but various modifications and innovations can be added without departing from the intent and scope of the claims by a person skilled in the art in fields of the present invention.

What is claimed is:

1. A testing method for a TFT array substrate using a self-emitting element drive where pixels are arranged in a matrix and a pixel which comprises a drive transistor having a gate formed from a first structural material and a source and a drain formed from a second structural material, and a hold capacitor having a first electrode formed from said first structural material and a second electrode formed from said second structural material, wherein the testing method comprises:

applying a first voltage to said hold capacitor;

applying a second voltage to said hold capacitor after said first step;

measuring the charge in said pixel after applying said second voltage; and calculating the capacitance of said hold capacitor from said charge and the potential difference between said first voltage and said second voltage.

2. The testing method of claim 1, which further comprises:

implementing said applying a first and second voltage, measuring and calculating steps for a plurality of pixels;

generating the first array arranged based on said capacitances of said plurality of pixels based on the pixel arrangement;

applying a designated filter on said first array and generating a second array; and comparing said first array to said second array and determining the nonuniformities in the capacitances of said hold capacitors.

3. A testing method for a TFT array substrate using a self-emitting element drive where pixels are arranged in a matrix and a pixel which comprises a drive transistor having a gate formed from a first structural material and a source and a drain formed from a second structural material, and a hold capacitor having a first electrode formed from said first structural material and a second electrode formed from said second structural material, wherein the testing apparatus comprises:

one or a plurality of power supplies for applying first and second voltages to said pixels;

a measurement device for measuring the charge in said pixel;

a controller for applying said second voltage after applying said first voltage to the designated pixel and measuring the charge by said measurement device after applying said second voltage; and a processor for determining the capacitance of said hold capacitor from said charge and the potential difference between said first voltage and second voltage.

4. The testing apparatus of claim 3, wherein said controller has a function for measuring said charges of a plurality of said pixels; and said processor has a function for determining the nonuniformities in the capacitances of said hold capacitors of said pixels.

* * * * *